US006919862B2

(12) United States Patent
Hacker et al.

(10) Patent No.: US 6,919,862 B2
(45) Date of Patent: Jul. 19, 2005

(54) HIGH IMPEDANCE STRUCTURES FOR MULTIFREQUENCY ANTENNAS AND WAVEGUIDES

(75) Inventors: Jonathan Bruce Hacker, Thousand Oaks, CA (US); Moonil Kim, Thousand Oaks, CA (US); John A. Higgins, Westlake Village, CA (US)

(73) Assignee: Rockwell Scientific Licensing, LLC, Thousand Oaks, CA (US)

( * ) Notice: Subject to any disclaimer, the term of this patent is extended or adjusted under 35 U.S.C. 154(b) by 0 days.

(21) Appl. No.: 10/673,024

(22) Filed: Sep. 26, 2003

(65) Prior Publication Data

US 2004/0066340 A1 Apr. 8, 2004

Related U.S. Application Data

(62) Division of application No. 09/644,876, filed on Aug. 23, 2000, now Pat. No. 6,628,242.

(51) Int. Cl.[7] ..... H01Q 15/02

(52) U.S. Cl. ..... 343/909; 343/771; 343/700 MS; 333/248

(58) Field of Search ..... 343/700 MS, 770, 343/771, 829, 846, 909; 333/247, 248

(56) References Cited

U.S. PATENT DOCUMENTS

| | | | | |
|---|---|---|---|---|
| 4,870,375 A | * | 9/1989 | Krueger et al. | 333/33 |
| 5,115,217 A | * | 5/1992 | McGrath et al. | 333/246 |
| 5,497,168 A | | 3/1996 | Thomas et al. | 343/834 |
| 6,208,316 B1 | | 3/2001 | Cahill | 343/909 |
| 6,366,254 B1 | * | 4/2002 | Sievenpiper et al. | 343/770 |
| 6,426,722 B1 | | 7/2002 | Sievenpiper et al. | 343/909 |
| 6,552,696 B1 | * | 4/2003 | Sievenpiper et al. | 343/909 |

FOREIGN PATENT DOCUMENTS

| | | | |
|---|---|---|---|
| FR | 2518828 | 6/1983 | 343/909 |

OTHER PUBLICATIONS

CRC Press, *The Electrical Engineering Handbook 2nd Edition*, Dorf, p. 970, (1997).

D. Sievenpiper, "High Impedance Electromagentic Surfaces," (1999) *PhD Thesis*, University of California, Los Angeles.

C.M. Liu et al., *Monolithic 40 Ghz 670 Mw HBT Grid Amplifier*, (1996) IEEE MTT–S, p. 1123.

(Continued)

*Primary Examiner*—Tho Phan

(74) *Attorney, Agent, or Firm*—Koppel, Jacobs, Patrick & Heybl

(57) ABSTRACT

A multi layered high impedance structure presents a high impedance to multiple frequency signals, with a different frequency for each layer. Each layer comprises a dielectric substrate, and an array of radiating elements such as parallel conductive strips or conductive patches on the substrate's top surface, with a conductive layer on the bottom surface of the bottommost layer. The radiating elements of succeeding layers are vertically aligned with conductive vias extending through the substrates to connect the radiating elements to the ground plane. Each layer presents as a series of parallel resonant L-C circuits to an E field at a particular signal frequency, resulting in a high impedance surface at that frequency. The new structure can be used as the substrate for a microstrip patch antenna to provide an optimal electrical distance between the resonator and backplane at multiple frequencies. It can also be used in waveguides that transmit multiple signal frequencies signals in one polarization or that are cross-polarized. As a waveguide it maintains a near-uniform density E and H fields, resulting in near uniform signal power density across the waveguide's cross-section.

23 Claims, 7 Drawing Sheets

OTHER PUBLICATIONS

M. Kim et al. *A Rectangular TEM Waveguide With Photonic Crystal Walls for Excitation of Quasi–Optic Amplifiers*, (1999) IEEE MTT–S, Archived on CDROM pp. 1–4.

M.A. Ali et al., *Analysis and Measurement fo Hard Horn Feedsfor the Excitation of Quasi–Optical Amplifiers*, (1998) IEEE MTT–S, pp. 1913–1921.

* cited by examiner

HIGH IMPEDANCE STRUCTURES FOR MULTIFREQUENCY ANTENNAS AND WAVEGUIDES

This application is a divisional of patent application Ser. No. 09/644,876 filed on Aug. 23, 2000, now U.S. Pat. No. 6,628,242 and claims priority of that application.

BACKGROUND OF THE INVENTION

1. Field of the Invention

This invention relates to high impedance structures that allow microstrip antennas to radiate at more than one frequency and waveguides to transmit at more than one frequency.

2. Description of the Related Art

Microstrip patch and strip antennas are often used in applications requiring a low profile, light weight and bandwidths less than a few percent. The basic microstrip antenna includes a microstrip line resonator consisting of a thin metallic conducting patch etched on a dielectric substrate and conductive layer on the dielectric substrate's surface opposite the resonator. [CRC Press, *The Electrical Engineering Handbook* $2^{nd}$ *Edition,* Dorf, Pg. 970, (1997)] The dielectric substrate is commonly made of TEFLON→fiberglass that allows it to be curved to conform to the shape of the mounting surface, and the conductive materials are commonly made of copper. The substrate generally has a thickness approximately equal to one fourth of the wavelength of the antenna's radiating signal. This provides the electrical distance between the conductive layer and antenna's radiating element to promote signal radiation into one hemisphere and to provide optimal gain.

One disadvantage of these types of antenna is that the fixed electrical distance between the radiating element and the conductive layer limits efficient radiation to a narrow bandwidth around a center frequency. The radiation and other related properties (antenna impedance, for example) will be seriously degraded as the operating frequency moves away from the center frequency. Another disadvantage of this structure is that the dielectric substrate and the conductive layer can support surface and substrate modes that can further degrade antenna performance. Also, surface currents can flow on the conductive layer that can deteriorate the antenna pattern by decreasing the front-to-back ratio.

A photonic surface structure has been developed which exhibits a high wave impedance to a signal's electric (E) field over a limited bandwidth. [D. Sievenpiper, "High Impedance Electromagnetic Surfaces," (1999) *PhD Thesis,* University of California, Los Angeles]. The surface structure comprises "patches" of conductive material mounted in a substrate of dielectric material, with "vias" of conducting material running from each patch to a continuous conductive sheet on the opposite side of the dielectric substrate. The structure appears similar to numerous thumbtacks through the substrate to the conductive sheet. It presents a series of resonant L-C circuits to an incident E field of a specific frequency, while the gaps between the patches block surface current flow.

This structure can be used as the substrate in a microstrip antenna to enhance performance by suppressing the antenna surface and substrate modes. It also increases the front to back ratio by blocking surface current. However, it only functions within a small bandwidth around a center frequency. As the frequency moves from the center, the structure will appear as a conductive plane that can again support undesirable modes.

New generations of communications, surveillance and radar equipment require substantial power from solid state amplifiers at frequencies above 30 gigahertz (GHz). Higher frequency signals can carry more information (bandwidth), allow for smaller antennas with very high gain, and provide radar with improved resolution. For solid state amplifiers, as the frequency of the signal increases, the size of the transistors within the amplifiers and the amplifier power output decrease. At higher frequencies, more amplifiers are required to achieve the necessary power level. To attain power on the order of watts, for signals having a frequency of approximately 30 GHz, hundreds of amplifiers must be combined. This cannot be done by power combining networks because of the insertion loss of the network transmission lines. As the number of amplifiers increases, a point will be reached at which the loss experienced by the transmission lines will exceed the gain produced by the amplifiers.

One current method of amplifying high frequency signals is to combine the power output of many small amplifiers oriented in space in a two-dimensional quasi-optic amplifier array. The array amplifies a beam of energy normal to it rather than a signal guided by a transmission line. It can combine the output power of hundreds of solid state amplifiers within the array. A waveguide can guide the beam of energy to the array, or the beam can be a Gaussian beam aimed in free space at the array. [C. M. Liu et al., *Monolithic* 40 *Ghz* 670 *mW HBT Grid Amplifier,* (1996) *IEEE MTT-S,* p.1123].

One type of waveguide for high frequency signals has a rectangular cross-section and conductive sidewalls. A signal source at one end transmits a signal down the waveguide to a quasi-optical amplifier array mounted at the opposite end, normal to the waveguide. However, this type of waveguide does not provide an optimal signal to drive an amplifier array. For instance, a vertically polarized signal has a vertical electric field component(E) and a perpendicular magnetic field component(H). Because the waveguides sidewalls are conductive, they present a short circuit to the E field, which therefore must be zero at the sidewalls. The power densities of both the E and H fields drop off as the sidewall is approached. The power density of the transmission signal varies from a maximum at the middle of the waveguide to zero at its sidewalls. If the waveguide's cross-section were shaped to support a horizontally oriented signal, the same problem would exist with the signal dropping off near the waveguide's top and bottom walls.

This power drop-off reduces the amplifying efficiency of the amplifier array. For efficient amplification, each individual amplifier in the array should be driven by the same power level, i.e. the power density should be uniform across the array. When amplifying the type of signal provided by a metal waveguide, the amplifiers at the center of the array will be overdriven before the edge amplifiers can be driven adequately. Also, individual amplifiers in the array will see different source and load impedances, depending upon their locations in the array. The reduced power amplitude, along with impedance mismatches at the input and output, make most of the edge amplifiers ineffective. The net result is a significant reduction in the potential output power.

Waveguides having high impedance walls can transmit a signal without the E and the H fields dropping off at the sidewalls. For example, with the Sievenpiper thumbtack high impedance surface (described above) on the sidewalls and with the waveguide transmitting a vertically polarized signal, the sidewalls will appear as an open circuit to the signal's E field. The E field will be transverse to the sidewalls and will not experience the drop-off associated with a conductive surface. Current will also flow down the waveguide's top and bottom walls to support a uniform H field. However, because the gaps between the patches of the high impedance structure do not allow surface conduction in any direction, the waveguide cannot transmit cross-polarized signals with uniform density. Also, the waveguide can only transmit a signal within a limited bandwidth of the center frequency.

A high impedance wall structure has also been developed having conductive strips instead of conductive patches. [M. Kim et al., *A Rectangular TEM Waveguide with Photonic Crystal Walls for Excitation of Quasi-Optic Amplifiers,* (1999) *IEEE MTT-S,* Archived on CDROM]. The wall is particularly applicable to rectangular waveguides transmitting cross-polarized signals. Either two or four of the waveguide's walls can have this structure, depending upon the polarizations of the signal being transmitted. The wall comprises a substrate of dielectric material with parallel strips of conductive material that are equal distances apart. It also includes conductive vias through the sheet to a conductive sheet on the substrate's surface opposite the strips. When used for the walls of a rectangular waveguide, the structure provides a high impedance termination for the E field component of a signal and also allows conduction through the strips to support the H field component. When used for all four of the waveguide's walls, the waveguide can transmit cross-polarized signals similar to a free-space wave having a near-uniform power density.

However, like the thumbtack structure, the strip structure only functions within a limited bandwidth of a center frequency. Outside the bandwidth the wall will appear as a conductive surface to the signal, and the power densities of the E and H fields will drop off towards the waveguide's walls. The waveguide can efficiently drive an amplifier array only within a small bandwidth around a specific center frequency.

Dielectric-loaded waveguides, so called hard-wall horns, have been shown to improve the uniformity of signal power density. [M. A. Ali, et.al., *Analysis and Measurement of Hard Horn Feeds for the Excitation of quasi-Optical Amplifiers,* (1998) *IEEE MTT-S,* pp. 1913–1921]. While an improvement in uniformity, this approach still does not provide optimal performance for an amplifier array in which input and output fields of a signal are cross polarized.

SUMMARY OF THE INVENTION

The present invention provides an improved surface structure that present a high impedance to the E fields of signals at widely separated frequencies. The structure has at least two layers, with each layer presenting a high impedance surface to the E field component of a signal within at a respective frequency. Each layer is also transparent to the E field of signals with frequencies lower than its respective frequency, and each layer appears as a conductive surface to the E field of signals with frequencies higher than its respective frequency. Of the layers, the bottommost layer presents as a high impedance to the E field of the lowest frequency with each succeeding layer presenting as a high impedance to the E field from successively higher frequencies.

Each layer of the new structure includes a dielectric substrate and an array of radiating elements preferably either conductive strips or patches on one side of the substrate. A conductive layer is provided on the lower surface of the bottom layer's substrate, opposite its radiating elements. The conductive strips are preferably parallel with uniform gaps between adjacent strips, while the conductive patches are preferably equally spaced and sized. Subsequent layers are attached over the bottom layer with their radiating elements vertically aligned with those on the bottom layer.

The new structure preferably includes conductive vias from the radiating elements to the ground plane which run through the centers of the aligned patches in the patch embodiment, and are equally spaced along the strip centerlines in the strip embodiment. The dimensions of the various components of the impedance layers depend upon the materials used and each successive layer's design frequency. The high impedance level for each layer is established by an L-C circuit which results from an inductance presented by its vias and a capacitance presented by the gap between the radiating elements.

The new structure is particularly applicable to microstrip patch and slot antennas, and to waveguides. In patch antennas, the invention provides an efficient adaptive reflective backplane over a greater range of frequencies than has previously been attainable. The layered structure can be designed to adapt its reflected phase to maintain an optimum electrical distance over multiple frequencies. The structure also suppresses current and substrate modes, reducing the degradation of the antenna's performance due to these undesired effects. The gaps between the patches reduce the undesired effects produced by surface current.

For waveguides that transmit a signal in one polarity (vertical or horizontal), the new wall structure is used for two opposing walls. For waveguides that transmit cross-polarized signals (both horizontal and vertical), the new wall structure is used for all four walls and acts as a high impedance to the transverse E field component of signals in both polarizations. With strips rather than patches as the radiating elements, the new wall structure also allows current to flow down the waveguide, which provides for a uniform H field in both polarizations. The power wave within the waveguide assumes the characteristics of a plane wave with a transverse electric and magnetic (TEM) instead of a transverse electric (TE) or transverse magnetic (TM) propagation. This transformation of the energy flow in the waveguide provides a wave similar to that of a free-space wave propagation having near-uniform power density. The new waveguide can maintain cross-polarized signals at different frequencies, with each signal having a uniform power density.

These and further features and advantages of the invention will be apparent to those skilled in the art from the following detailed description, taken together with the accompanying drawings, in which:

DETAILED DESCRIPTION OF THE INVENTION

Figure 1:
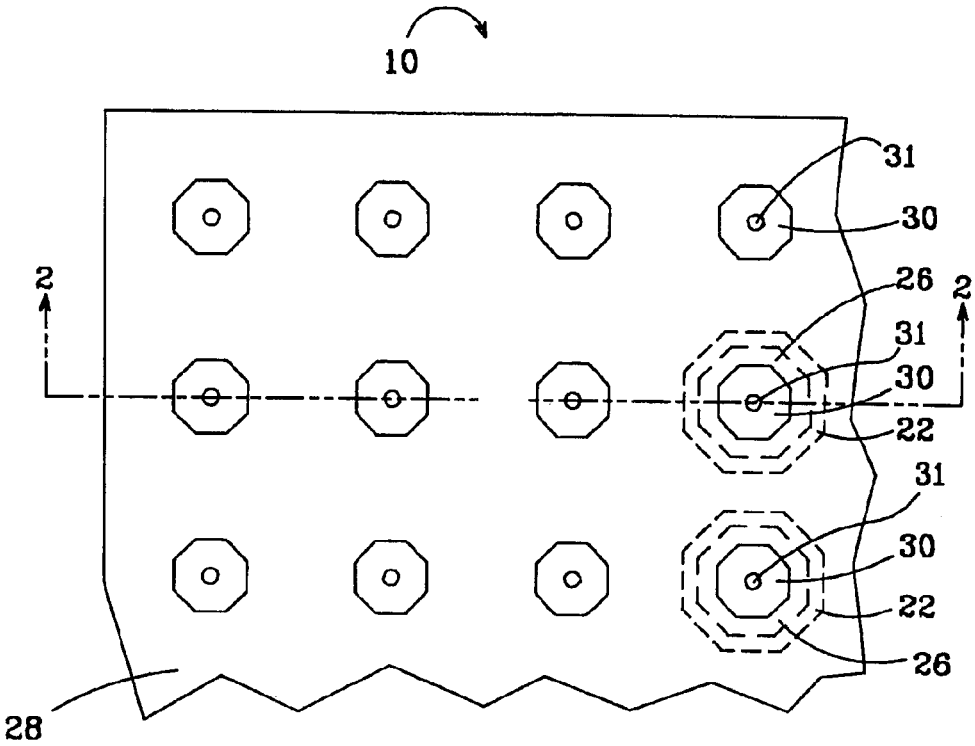
FIG. 1 is a plan view of a conductive patch embodiment of the new high impedance structure.
Figure 2:
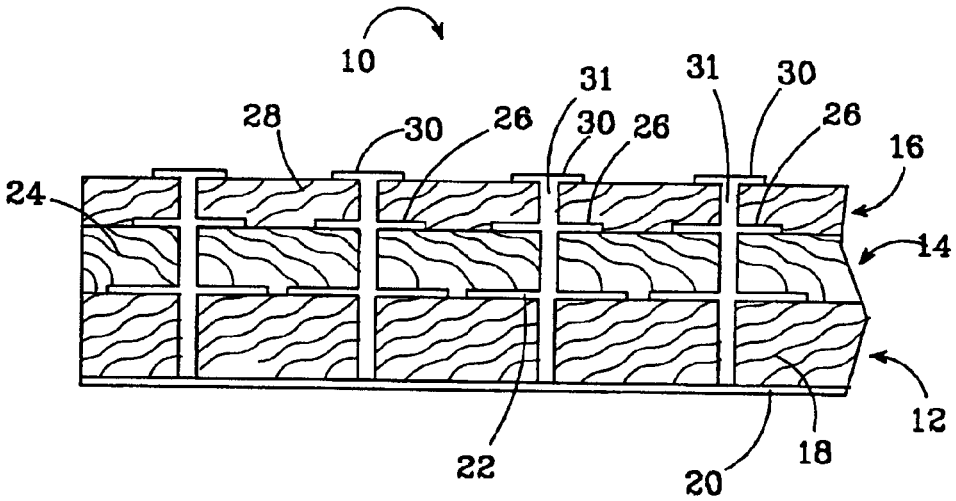
FIG. 2 is a cross-section of the new structure of FIG. 1, taken along section lines 2—2.

FIGS. 1 and 2 show one embodiment of a new layered high impedance structure 10 in which conductive hexagonal patches are provided on each layer. The new structure can have different numbers of layers, depending upon the number of different signal frequencies to be transmitted. Referring to FIG. 2, the embodiment shown has three similar layers 12, 14, and 16, with each layer having different dimensions or made from different materials such that each presents as a high impedance to the E field from a different respective signal frequency bandwidth.

As further shown in FIG. 2, the bottom layer 12 comprises a substrate of dielectric material 18 with an array of preferably equally spaced conductive patches 22 on its upper surface (see also FIG. 1). The bottom layer also has a conductive layer 20 on its bottom surface. The second layer 14 does not have a conductive layer, but is otherwise similar to and formed over the bottom layer 12 with conductive patches 26 (see also FIG. 1) located directly above and vertically aligned with the first layer patches 22. The second layer's dielectric substrate 24 is thinner than the first layer's substrate 18 and its patches 26 are smaller than the first layer's patches 22. The distance between adjacent patches 26 is greater than the distance between patches 22. These differences cause the second layer to present a high impedance as a frequency bandwidth greater than for the first layer.

The third layer 16 is similar to the second layer 14. Its dielectric substrate 28 is thinner than substrates 18 and 24, and it's patches 30 (see also FIG. 1) are located directly above and vertically aligned with patches 22 and 26. The patches 30 are smaller than the patches below it and the distance between adjacent patches is greater.

Conductive vias 31 extend through each of the dielectric substrates 18, 24 and 28, to connect the vertically aligned patches of each layer to the conductive layer 20. The vias 31 can have different cross-sections such as square or circular.

Figure 3:
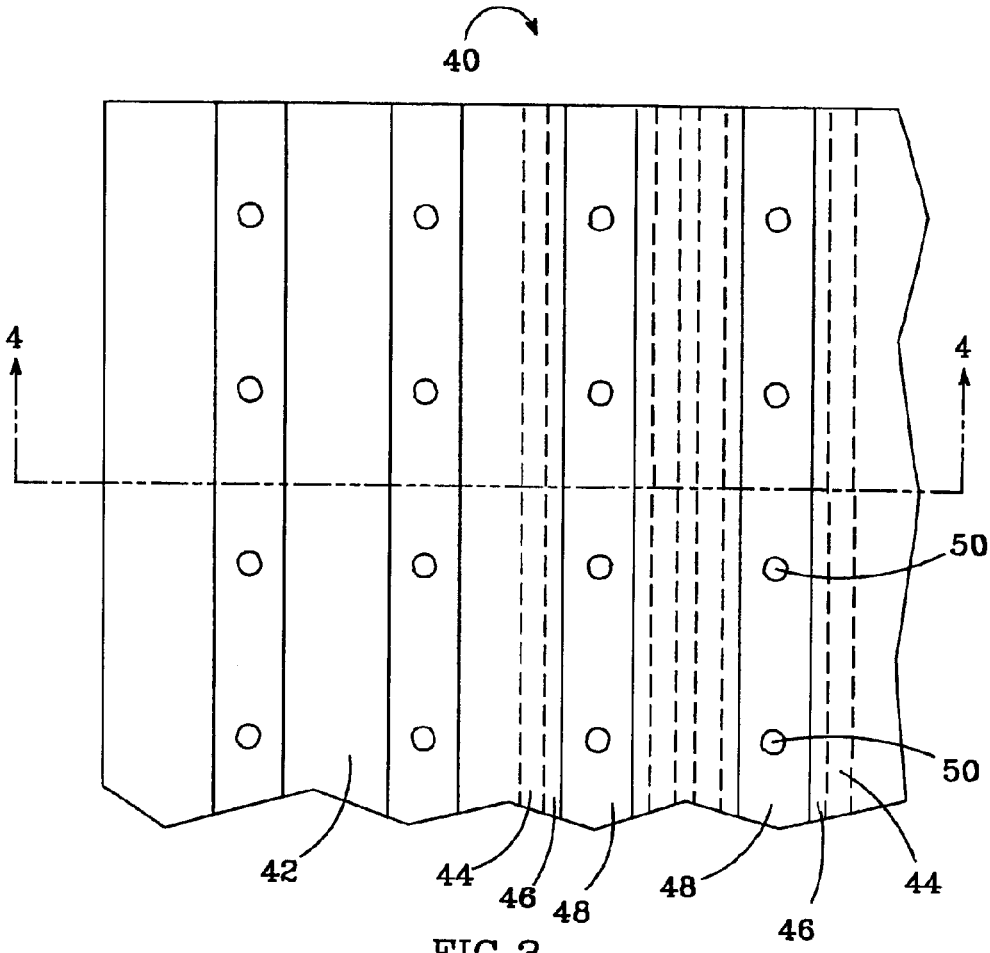
FIG. 3 is a plan view of a conductive strip embodiment of the new high impedance structure.
Figure 4:
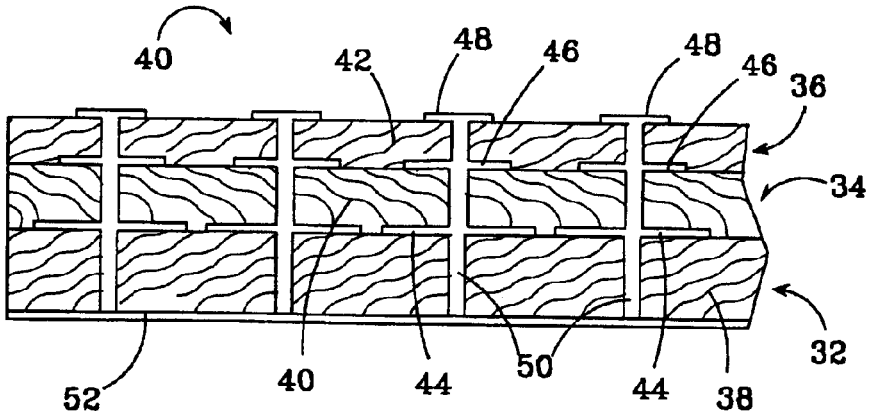
FIG. 4 is a cross-section of the new structure of FIG. 3, taken along section lines 4—4.

FIGS. 3 and 4 show another three-layered embodiment of the invention with parallel conductive strips instead of conductive patches. It also presents a high impedance to E fields at three different frequency bandwidths, but the E fields must have a component that is transverse to the conductive strips. Like the patch embodiment 10, each of its layers 32, 34, and 36 (shown in FIG. 4) have respective dielectric substrates 38, 40, and 42 that are progressively thinner from the bottom layer 32 to the top 36. Conductive strips 44, 46, and 48 are provided respectively on substrates 32,34 and 36 and are progressively thinner from the bottom layer to the top. The strips in each layer are parallel and aligned over the strips in the layers below and above, and preferably have uniform width and a uniform gap between adjacent strips. Because the width of the strips progressively decreases for each successive layer, the gaps between adjacent strips progressively increases.

The new structure 40 also includes vias 50 that connect each vertically aligned set of strips to a ground plane conductive layer 52 (see FIG. 2) located at the underside of the bottom layer 32. The vias are preferable equally spaced down the longitudinal centerlines of the strips. The location of the vias 50 can be staggered for adjacent strips.

The new structure is constructed by stacking layers of metalized dielectric substrates. Numerous materials can be used for the dielectric substrates, including but not limited to plastics, poly-vinyl carbonate (PVC), ceramics, or high resistance semiconductor materials such as Gallium Arsenide (GaAs), all of which are commercially available. Each layer in the new structure can have a dielectric substrate of a different material and/or a different dielectric constant. A highly conductive material such as copper or gold (or a combination thereof) should be used for the conductive layer, patches, strips, and vias.

In the strip embodiment, parallel gaps in the conductive material are then etched away using any of a number of etching processes such as acid etching or ion mill etching. Within each layer, the etched gaps are preferably of the same width and the same distance apart, resulting in parallel conductive strips on the dielectric substrate of uniform width and with uniform gaps between adjacent strips. In the case of the patch embodiment, the conductive material can be etched away by the same process, preferably leaving equally spaced and equally shaped patches of conductive material. A preferred shape for the patches is hexagonal, but other shapes can also be used.

The different layers are then stacked with the strips or patches for each layer aligned with corresponding ones in the layers above and below. The layers are bonded together using any of the industry standard practices commonly used for electronic package and flip-chip assembly. Such techniques include solder bumps, thermo-sonic bonding, electrically conductive adhesives, and the like.

Once the layers are stacked, holes are formed through the structure for the vias. The holes can be created by various methods, such as conventional wet or dry etching. The holes are then filled or at least lined with the conductive material and preferably at the same time, the exposed surface of the bottom substrate is covered with a conductive material to form conductive layers 20 or 52. A preferred processes for this is sputtered vaporization plating. The holes do not need to be completely filled, but the walls must be covered with the conductive material sufficiently to eclectically connect the ground plane to the radiating elements of each layer.

Each layer in the structure presents a pattern of parallel resonant L-C circuits and a high impedance to an E field for different signal frequencies. The bottom most layer presents a high impedance to the lowest frequency and the top most layer presents as a high impedance to the highest frequency. For the strip embodiment, at least a component of, and preferably the entire E field, must be transverse to the strips. A signal normally incident on this structure and within one of the frequency bandwidths, will ideally be reflected with a reflection coefficient of +1 at the resonant frequency, as opposed to a −1 for a conductive material.

The capacitance of each layer is primarily dependant upon the widths of the gaps between adjacent strips or patches, but is also impacted by the dielectric constants of the respective dielectric substrates. The inductance is primarily dependent upon the substrate thickness and the diameter of the vias.

The dimensions and/or compositions of the various layers are different to produce the desired high impedance to different frequencies. To resonate at higher frequencies, the thickness of the dielectric substrate can be decreased, or the gaps between the conductive strips or patches can be increased. Conversely, to resonate at lower frequencies, the thickness of the substrate can be increased or the gaps between the conductive strips or patches can be decreased. Another contributing factor is the dielectric constant of the substrate, with a higher dielectric constant increasing the gap capacitance. These parameters dictate the dimensions of the structures 30 and 40. Accordingly, the layered high impedance ground plane structures described herein are not intended to limit the invention to any particular structure or composition.

For example, in a two layer patch embodiment presenting high impedances to the E-fields of 22 GHz and 31 GHz signals and having substrates with a 3.27 dielectric constant, the top and bottom substrates are 30 mils and 60 mils thick, respectively. The patches are hexagonal with a center-to-center spacing of 62.2 mil. The patches on each layer are the same size and the gap between adjacent patches is 10 mil. The vias have a square 15 mil by 15 mil cross section and extend through both layers. The patches are centered on the vias in both layers.

The layers of the new wall structure also act as a high impedance to a limited frequency band around their design frequency, usually within a 10–15% bandwidth. For example, a layer in the structure designed for a 35 GHz signal will present a high impedance to a frequency range of about 32.5–37.5 GHz. As the frequency deviates from the design resonant frequency, the performance of the surface structure degrades. For frequencies far above the center frequency, the patches or strips will simply appear as conductive sheets. For frequencies far below the design frequency, the layer will be transparent.

Figure 5:
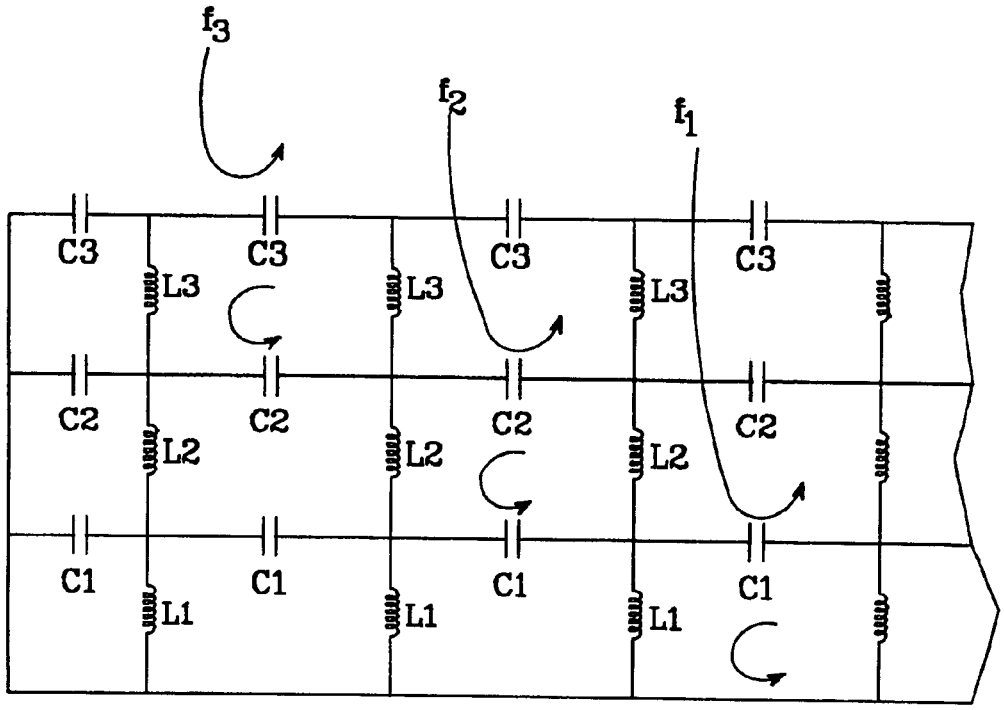
FIG. 5 is a diagram of L-C circuits formed by the new structure in response to the E fields of three different frequency bandwidths.

FIG. 5 illustrates the network of capacitance and inductance presented by a new three layer structure which produces an array of resonant L-C circuits to three progressively higher frequencies f1, f2 and f3. The bottommost layer appears as a high impedance surface to signal f1 as a result of a series of resonant L-C L1/C1 representing the equivalent inductance and capacitance presented by the bottommost layer to its design frequency bandwidth. The second and third layers also for respective series of resonant L-C circuits L2/C2 and L3/C3, at their frequency bandwidths.

Figure 6A:
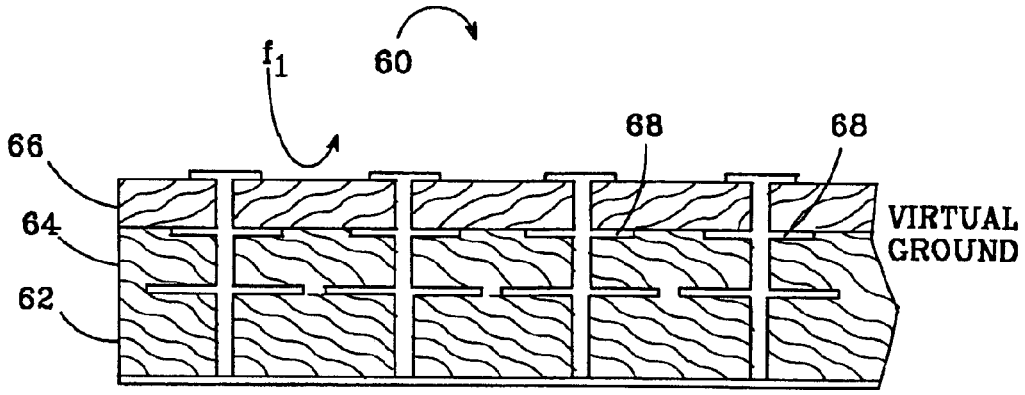
FIGS. 6*a*–6*c* are sectional views of a three-layer embodiment of the invention, illustrating how three frequency bandwidths interact with the different layers.
Figure 6B:
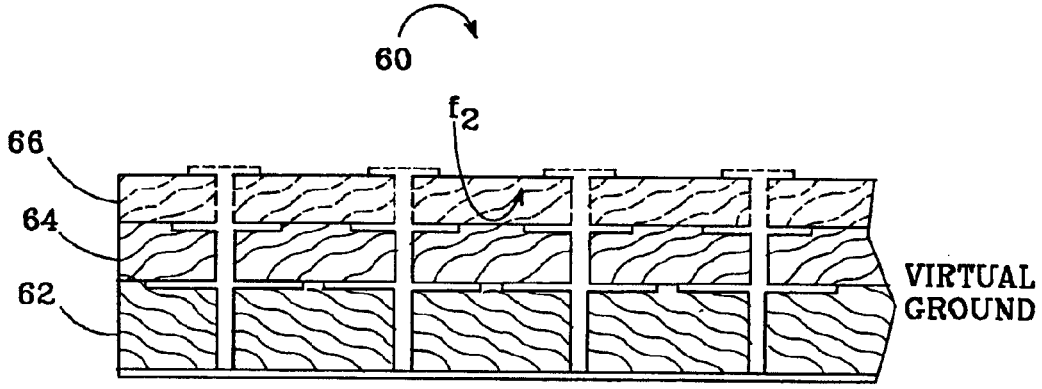
Figure 6C:
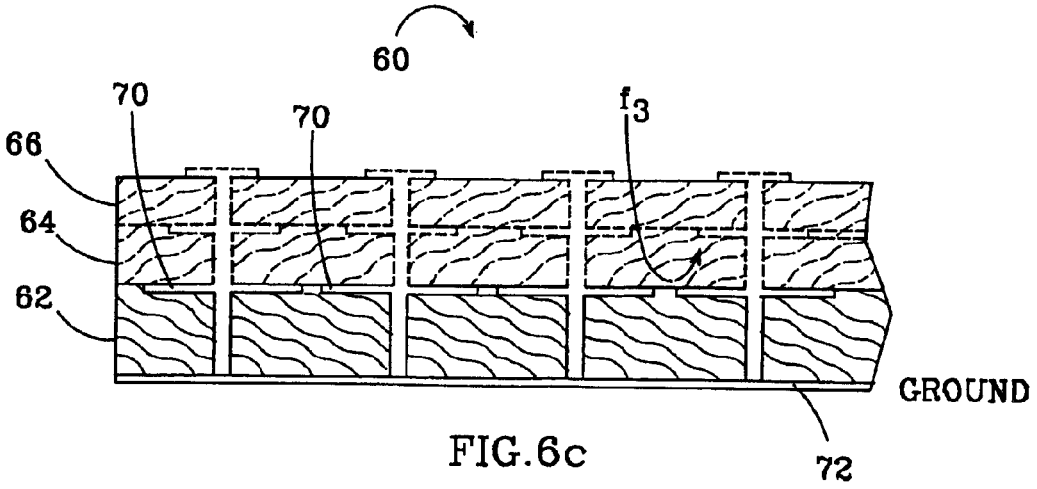

FIGS. 6*a*–6*c* illustrate how the three signals interact with layers of the new structure 60, for both the conductive patch and conductive strip embodiments. An important characteristic of the structure's layers 62, 64, and 66 is that each appears transparent to E fields at frequencies below its design frequency, while the strips or patches in each appear as a conductive surface to E fields at frequencies above its design frequency. For the highest frequency signal f3, the top layer 66 will present high impedance resonant L-C circuits to the signal's E field. The patches/strips 68 (see FIG. 6*a*) on second layer 64 appear as a conductive layer and become a "virtual ground" for the top layer 62. f2 (see FIG. 6*b*) is lower in frequency than f1 (see FIG. 6*a*) and, as a result, the first layer 62 will be transparent to f2's E field, while the second layer 64 will appear as high impedance resonant L-C circuits. The patches 70 (see FIG. 6*c*) on the third layer will appear as a conductive layer, becoming the second layer's virtual ground. Similarly, at f3 (see FIG. 6*c*) the top and second layers 62 and 64 will be transparent, but the third layer 66 will appear as high impedance resonant L-C circuits, with the conductive layer 72 (see FIG. 6*c*) operating for the third layer 66.

Figure 7:
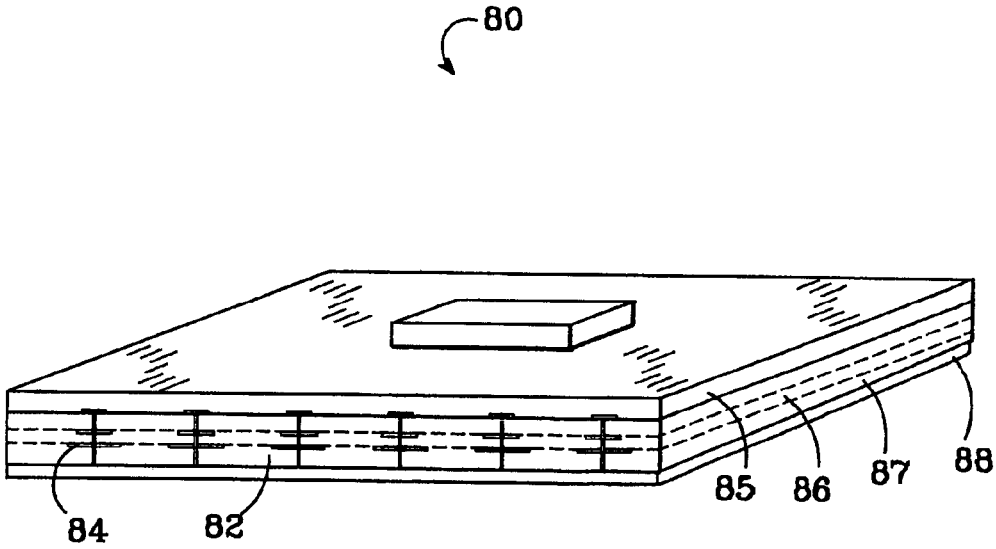
FIG. 7 is a perspective view of a microstrip antenna using the new high impedance structure.

FIG. 7 shows a microstrip antenna 80 using the new layered high impedance structure 82 as its backplane. In the preferred embodiment, the structure has hexagonal patches 84 instead of strips. Conventional microstrip antennas transmit at only one frequency, depending upon the thickness of the dielectric layer. Using the new structure, a microstrip antenna can transmit at multiple frequencies. An optimal electrical distance is maintained between the emitting element and the respective ground (virtual or actual) for each of the transmission frequencies. At the highest frequency, the antenna signal sees only the L-C circuits of the structures top layer 85, and the virtual ground provided by the second layer 86 will provide the optimal electrical distance. For the next highest frequency, the signal sees only the L-C circuits of the second layer 86 and the virtual ground of the bottom layer 87 provides the optimal electrical distance. For the lowest frequency at which the bottom layer 87 responds, the conductive layer 88 provides the optimal electrical distance.

Also, the gaps between the patches prevent surface current at each layer. This along with the L-C circuits presented by the layers help suppress surface and substrate modes and increase the front-to-back ratio, thereby improving the antenna signal.

Figure 8:
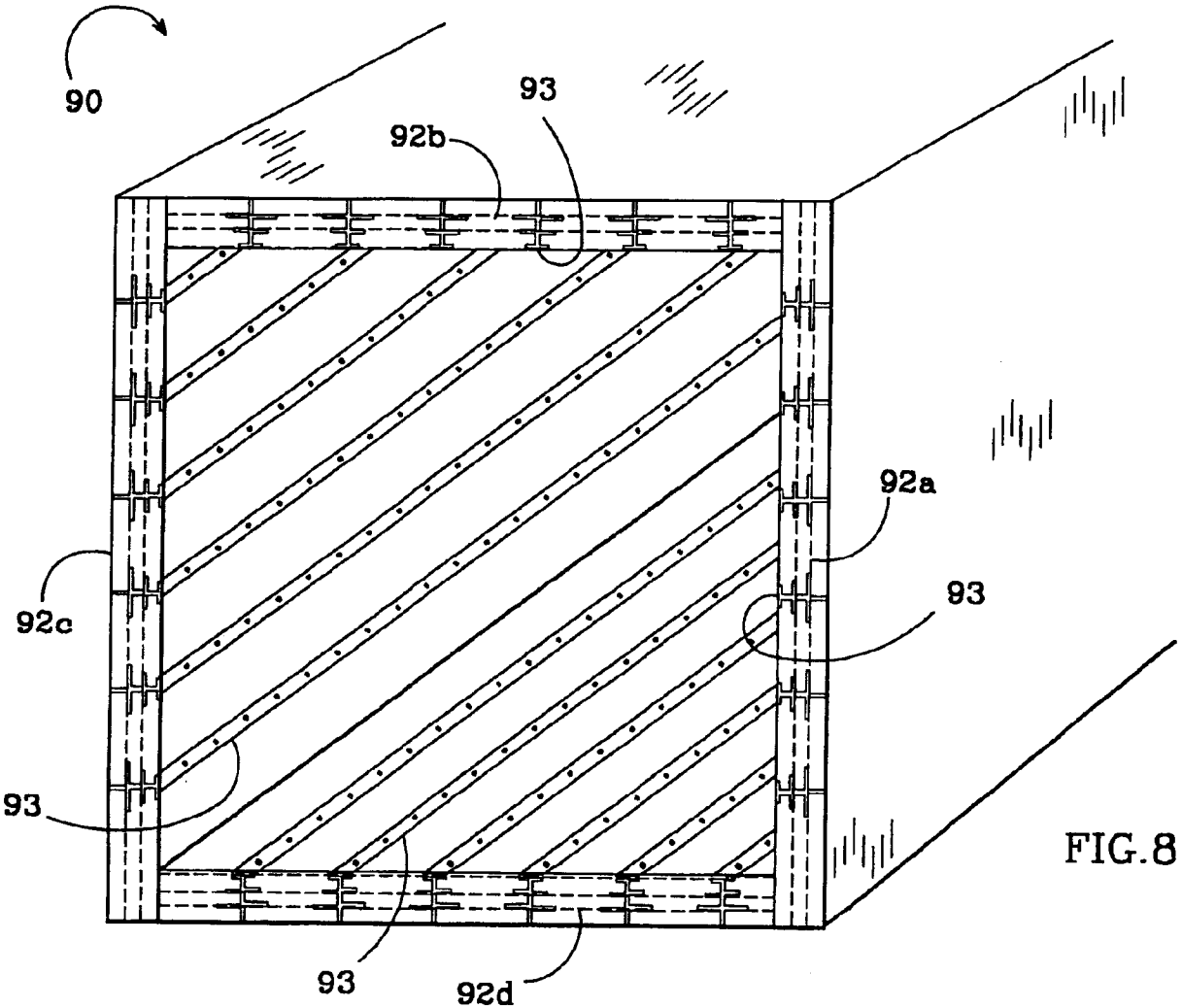
FIG. 8 is a perspective view of a waveguide with the new high impedance structure on all its sidewalls.

The new groundplane structure with conductive strips can also be used as the sidewalls of a waveguide or mounted to a waveguide's sidewalls by a variety of adhesives such as silicon glue. FIG. 8 shows a new metal waveguide 90 having the new layered structure mounted on the interior of all four walls 92*a–d,* with the conductive strips 93 oriented inward and longitudinally down the waveguide. The layered wall structure allows the waveguide 90 to transmit signals at multiple frequencies with both horizontal and vertical polarizations, while maintaining a uniform power density. The vertically polarized signal has a vertical E field component and a horizontal H field component. The E field maintains a uniform density as a result of the high impedance presented by the wall structure on the vertical sidewalls 92*a* and 92*c*. Current will also flow down the strips 93 on the top wall 92*b* and/or bottom wall 92*d,* maintaining a uniform H field. For the horizontally polarized signal, the E field will maintain a generally uniform power density because of the layered structure at the top and bottom wall 92*b* and 92*d,* and the H field will remain uniform because of current flowing down the conductive strips 93 of the sidewalls 92*a* and 92*c*. Thus, the cross-polarized signal will have a generally uniform power density across the waveguide. If the waveguide is transmitting a signal in one polarization (vertical or horizontal), it only needs the new layered structure on only two opposing walls to maintain the signals uniform power density: sidewalls for vertical polarization, and top and bottom for horizontal.

Figure 9:
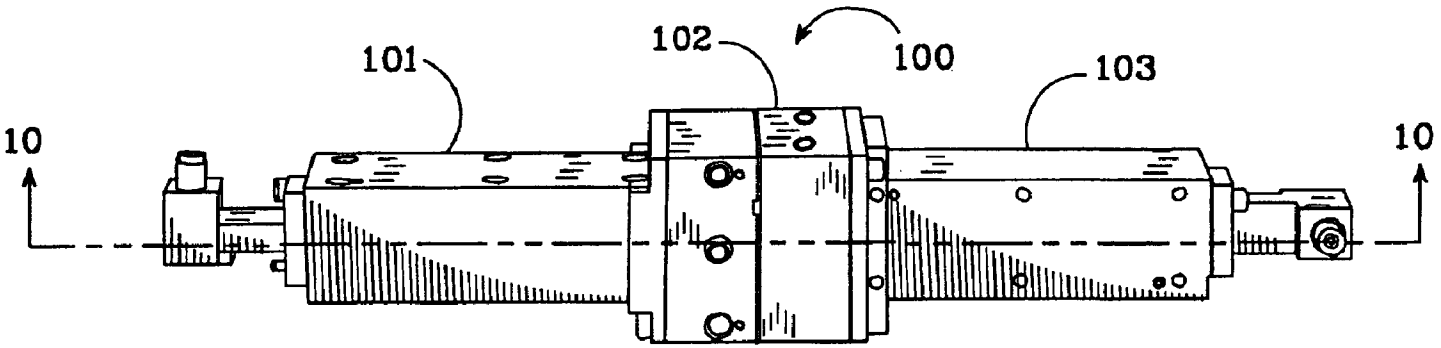
FIG. 9 is a perspective view of a horn waveguide to which the invention can be applied to for transmit multiple frequency signals with orthogonal input and output polarization.
Figure 10:
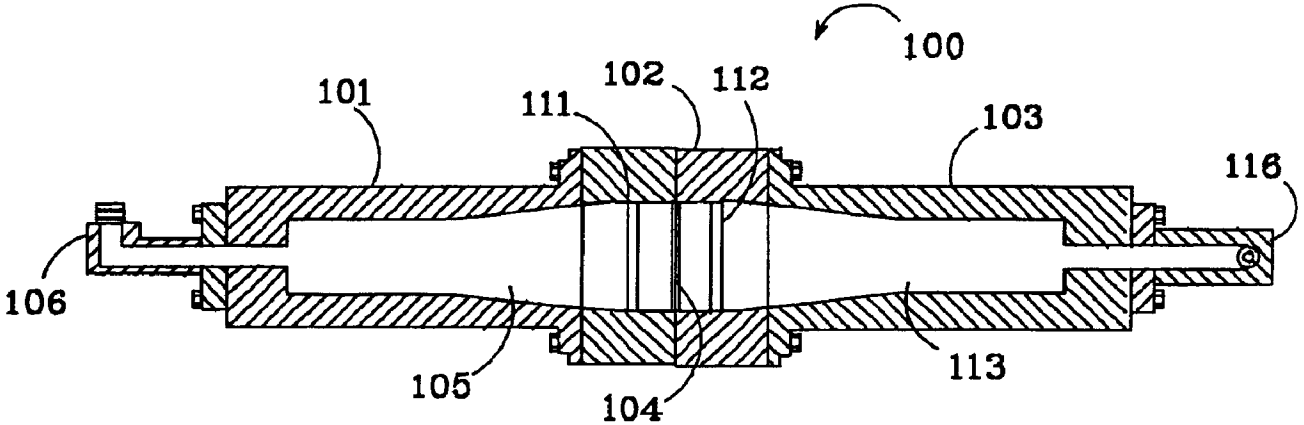
FIG. 10 is a cross section of the waveguide of FIG. 9 taken along section lines 10—10.
Figure 11C:
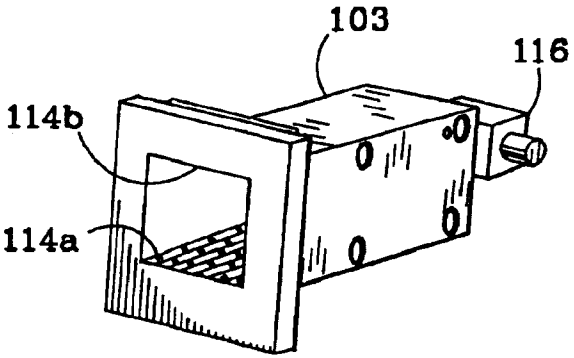
FIGS. 11*a,* 11*b* and 11*c* are perspective views illustrating the application of the invention to different sections of the waveguide in FIGS. 9 and 10.

FIGS. 9, 10 and 11*a–c* show a metal waveguide 100 with the new layered high impedance wall structure used on two walls in certain sections of the waveguide (FIGS. 11*a* and 11*b*) and on all four walls in another section (FIG. 11*c*). The new waveguide 100 can transmit signals with a uniform power density at different frequencies, the number of frequencies depending upon the number of layers in the wall structure. Referring to FIGS. 9 and 10, the waveguide comprises a horn input section 101, an amplifier section 102, and a horn output section 103. An amplifier array 104 is mounted in the amplifier section 102, near the middle.

The amplifier array 104 has a larger area than the cross section of the standard sized high frequency metal waveguide. As a result, the cross section of the signal must be increased from the standard size waveguide to accommodate the area of amplifier array 104 such that all amplifier elements of the array will experience the transmission signal. As shown in FIG. 10, the input section 101 has a tapered horn guide 105 that enlarges the beam to accommodate the larger amplifier array 104, while maintaining a single mode signal.

An input signal with vertical polarization enters the waveguide at the input adapter 106. As shown in FIG. 11*a* a new surface structure similar to the one shown in FIGS. 3 and 4 is affixed to the vertical sidewalls 107*a* and 107*b* of the input section 101. The polarization of the signal remains vertical throughout the input section 101. The E field component of the signals in the input section 101 will have a vertical orientation, with the H field component perpendicular to the E field. In this orientation, the new wall structure on sidewalls 107*a* and 107*b* will appear as an open circuit to the transverse E field, providing a hardwall boundary condition. In addition, current will flow down the top and/or bottom conductive wall, providing for a uniform H field. The uniform E and H fields provide for a near uniform signal power density across the input section 101.

Figure 11B:
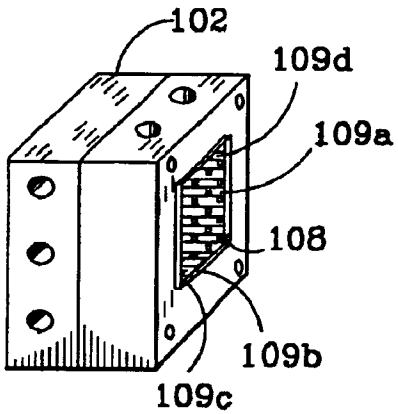
Figure 11A:
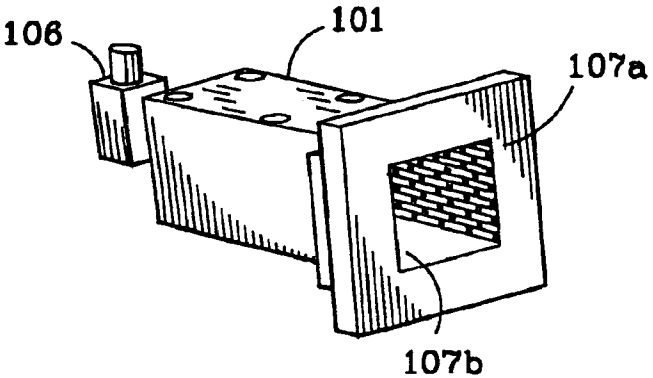

As shown in FIG. 11*b*, the amplifier section 102 of the waveguide contains a square waveguide 108 with the layered structure mounted on all four walls 109*a*–109*d* to support both a signal that is horizontally and vertically (cross polarized). Amplifier arrays 104 (see FIG. 10) are generally transmission devices rather than a reflection devices, with the signal entering one side of the array amplifier and the amplified signal transmitted out the opposite side. During transmission, amplifiers arrays also change polarity of the signal which reduces spurious oscillations. However, a portion of the input signal will maintain its input polarization as it transits the amplifier array. In addition, a portion of the output signal will reflect back to the to the waveguide area before the amplifier. Thus, in amplifier section 102 (see FIG. 11*b*) a signal with vertical and horizontal polarizations can exist.

As described above, the strip embodiment of the new wall structure allows the amplifier section 102 to support a signal with both vertical and horizontal polarizations. The wall structure presents a high impedance to the transverse E field of both polarizations, maintaining the E field density across the waveguide for both. The strips allow current to flow down the waveguide in both polarizations, maintaining a uniform H field density across the waveguide for both. Thus, the cross polarized signal will have uniform density across the waveguide.

Matching grid polarizers 111 and 112 (see FIG. 10) are mounted on each side of and parallel to the array amplifier 104, parallel to the array amplifier. The polarizers appear transparent to one signal polarization while reflecting a signal with an orthogonal polarization. For example, the output grid polarizer 112 allows a signal with an output polarization to pass, while reflecting any signal with an input polarization. The input polarizer 111 allows a signal with an input polarization to pass, while reflecting any signal with an output polarization. The distance of the polarizers from the amplifier can be adjusted, allowing the polarizers to function as input and output tuners for the amplifier, that provide a maximum benefit at a specific distance from the amplifier.

The output grid polarizer 112 reflects any input signal transmitted through the array amplifier 104 with a horizontal polarization. Thus, the signal at the output section 103 (see FIGS. 10 and 11*c*) will have only a vertical output polarity. Like the input section 101, the output section 103 is also a tapered horn guide 113 but is used to reduce the cross section of the amplified signal for transmission in a standard high frequency waveguide. As shown in FIG. 11*c*, to maintain a uniform density signal in the output section, the layered structures are mounted on the top and bottom walls 114*a* and 114*b* of the output section, with the strips oriented longitudinally down the waveguide. This allows for the output signal to maintain a near uniform power density. The output adapter 116 transmits the amplified signal out of the waveguide.

Although the present invention has been described in considerable detail with reference to certain preferred configurations thereof, other versions are possible. The surface structure described can be used in applications other than antennas and waveguides. It can be used in other applications needing a high impedance surface to the E field component of signals at different frequencies. Therefore, the spirit and scope of the appended claims should not be limited to the preferred versions described in the specification.

We claim:

1. A rectangular waveguide for transmitting electromagnetic signals, comprising:

a rectangular waveguide having four walls comprising two opposing sidewalls and a top and bottom wall; and a high impedance wall structure having at least two layers, at least said sidewalls or said top and bottom walls having said layered wall structure, each layer of said structure presenting a high impedance to the E field of a different signal frequency.

2. The waveguide of claim 1, further comprising an electromagnetic signal source at one end of said waveguide arranged to direct electromagnetic signals into said waveguide with an E field transverse to the waveguide axis and parallel to said wall structure.

3. The waveguide of claim 2, further comprising an amplifier mounted at the opposite end of the waveguide to amplify signals transmitted through the waveguide from said signal source.

4. The waveguide of claim 3, wherein said amplifier is an amplifier array.

5. The waveguide of claim 1, for a signal having a horizontal polarization, said high impedance wall structure provided on sidewalls of said waveguide.

6. The waveguide of claim 1, for a signal having a vertical polarization, said high impedance wall structure provided on sidewalls of said waveguide.

7. The waveguide of claim 1, for a signal having vertical and horizontal polarizations, said wall structure provided on all four walls of said waveguide.

8. The waveguide of claim 1, wherein each said layer of said structure comprises a substrate of dielectric material having a top and bottom surface and a plurality of radiating elements on said substrate's top surface, and further comprising a conductive layer on the bottom surface of the bottommost layer's dielectric substrate.

9. The waveguide of claim 8, wherein said radiating elements comprise parallel conductive strips longitudinally oriented down said waveguide.

10. The waveguide of claim 9, wherein corresponding conductive strips of said layers are vertically aligned further comprising conductive vias through said dielectric substrates between said aligned conductive strips and said conductive layer.

11. The waveguide of claim 9, wherein said conductive strips on each said layer have uniform width of and uniform gaps between adjacent strips.

12. The waveguide of claim 11, wherein the widths of said strips decreases and the width of said gaps increases with succeeding said layers from the bottommost said layer to the topmost.

13. The waveguide of claim 9, each said layer forms a series of resonant L-C circuits to electromagnetic wave at a respective frequency with an E field transverse to said conductive strips.

14. A multiple frequency electro-magnetic signal amplifier, comprising:

a waveguide input section having a rectangular cross section and four walls, further having a layered high impedance wall structure on two opposing walls;

a waveguide amplifier section having a rectangular cross section and four walls, further having an amplifier array mounted midway through said amplifier section and a layered high impedance wall structure on said four walls; and a waveguide output section having a rectangular cross-section and four walls, further having a layered high impedance wall structure on two opposing wall, wherein each said layer of said wall structure in each said section has two or more layers, each said layer presenting as high impedance to respective frequency E field that at least partially transverse to the waveguide axis and parallel to said wall structure, and a low impedance parallel to the waveguide axis.

15. The amplifier of claim 14, wherein said four walls of said input section comprise two sidewalls and a top and bottom wall, said layered high impedance wall structure mounted on said sidewalls.

16. The amplifier of claim 14, wherein said four walls of said output section comprise two sidewalls and a top and bottom wall, said layered high impedance wall structure on said top and bottom walls.

17. The amplifier of claim 14, said amplifier section further comprises two matching polarizers, one matching polarizer mounted on each side of said amplifier array, said layered high impedance wall structure on ea-i-d the side-walls and top and bottom walls.

18. The amplifier of claim 14, wherein each said layer of said wall structure comprises a substrate of dielectric material having a top and bottom surface and a plurality of radiating elements on said substrate's top surface, and further comprising a conductive layer on the bottom surface of the bottommost layer's dielectric substrate.

19. The amplifier of claim 18, wherein said radiating elements comprise parallel conductive strips longitudinally oriented down said waveguide.

20. The amplifier of claim 19, wherein corresponding conductive strips of said layers are vertically aligned, further comprising conductive vias through said dielectric substrates, between said aligned conductive strips and said conductive layer.

21. The amplifier of claim 19, wherein said conductive strips on each said layer have uniform widths and uniform gaps between adjacent strips.

22. The amplifier of claim 21, wherein the widths of said strips decreases and the width of said gaps increases with succeeding said layers from the bottommost said layer to the topmost.

23. The amplifier of claim 19, each said layer forms a series of resonant L-C circuits to electromagnetic wave at a respective frequency with an E field transverse to said conductive strips.

* * * * *